US006983771B2

(12) United States Patent
Halvarsson et al.

(10) Patent No.: US 6,983,771 B2
(45) Date of Patent: Jan. 10, 2006

(54) FEEDING DEVICE

(75) Inventors: Björn Halvarsson, Ulricehamn (SE); Patrik Magnusson, Boras (SE); Anders Svanström, Ulricehamn (SE)

(73) Assignee: Iropa AG, Baar (CH)

( * ) Notice: Subject to any disclaimer, the term of this patent is extended or adjusted under 35 U.S.C. 154(b) by 112 days.

(21) Appl. No.: 10/398,645

(22) PCT Filed: Oct. 17, 2001

(86) PCT No.: PCT/EP01/12023

§ 371 (c)(1),
(2), (4) Date: Sep. 2, 2003

(87) PCT Pub. No.: WO02/33156

PCT Pub. Date: Apr. 25, 2002

(65) Prior Publication Data

US 2004/0045621 A1 Mar. 11, 2004

(30) Foreign Application Priority Data

Oct. 18, 2000 (DE) ..... 100 51 635
Feb. 16, 2001 (DE) ..... 101 07 311
Jun. 26, 2001 (SE) ..... 0102272

(51) Int. Cl.
*D03D 47/36* (2006.01)

(52) U.S. Cl. ..... 139/452; 139/370.1; 242/634.7

(58) Field of Classification Search ..... 242/365.3, 242/364.7; 139/370.1, 452
See application file for complete search history.

(56) References Cited

U.S. PATENT DOCUMENTS 3,796,386 A * 3/1974 Tannert ..... 242/364.7
4,372,349 A 2/1983 Van Mullekom
4,744,394 A * 5/1988 Lincke ..... 139/452
4,781,225 A 11/1988 Van Donk et al.
5,072,760 A * 12/1991 Kaufman ..... 139/452
5,590,693 A * 1/1997 Pedrini et al. ..... 139/452
5,769,132 A * 6/1998 Tholander et al. ..... 139/450

FOREIGN PATENT DOCUMENTS

EP 0 250 359 A1 12/1987

* cited by examiner

*Primary Examiner*—John Calvert
*Assistant Examiner*—Andrew W. Sutton
(74) *Attorney, Agent, or Firm*—Flynn, Thiel, Boutell & Tanis, P.C.

(57) ABSTRACT

A feeding device for a mechanical weaving machine, including a winding element which can be driven in a rotating manner, a stationary storage, and at least one stop element. The stop element can be axially and radially moved in relation to the storage body, between an unwinding position releasing thread yarn and a stop position wherein the stop element is applied to the foremost winding and which ends the weft insertion. A yarn clamp is arranged downstream from the stop element, which initiates the respective weft insertion, and which can be switched between a passive position and a clamping position. The storage body has a small diameter, and the stop element is moved axially to the stop position solely by the windings due to a transport motion of the windings on the storage body.

22 Claims, 5 Drawing Sheets

2
W
F
6
4
3
5
K
11"
O
9
11
D
1
A
G
13
7
14
Q
10
S
3'
8
C
12

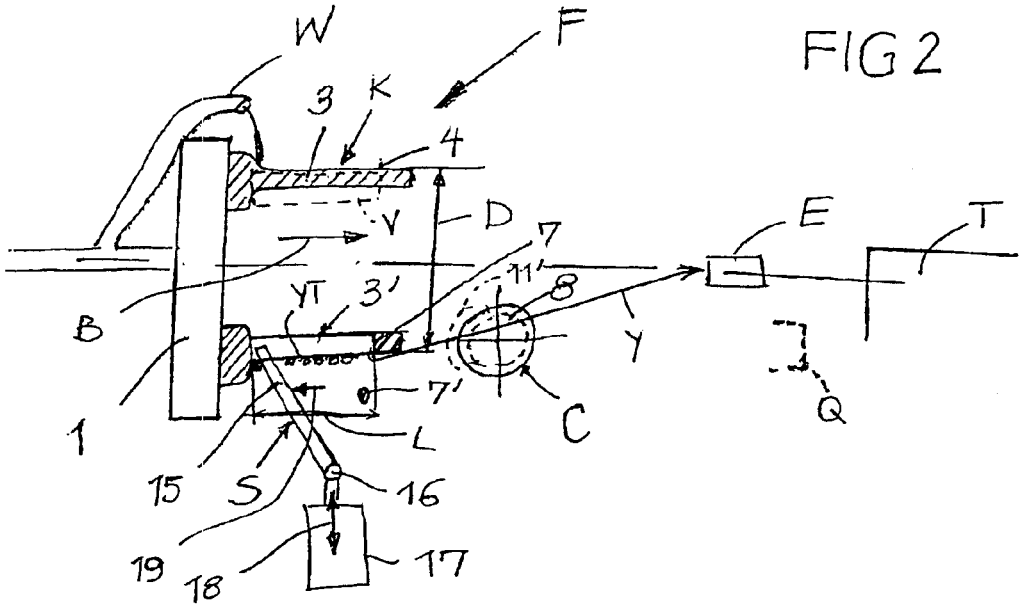
FIG 2
FIG 3
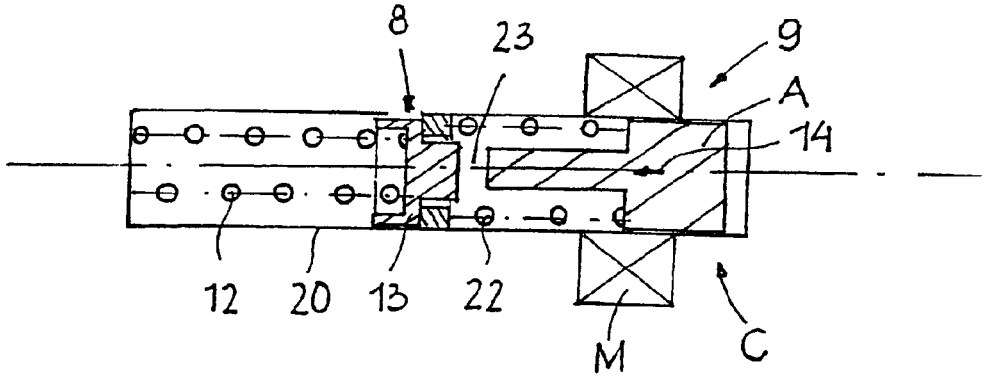

FEEDING DEVICE

FIELD OF THE INVENTION

The invention relates to a feeding device having a yarn-length measuring function for a weaving machine.

BACKGROUND OF THE INVENTION

A feeding device of this kind is known from DE 30 32 971 C. This known feeding device is operated alternatingly together with at least one further similar feeding device. The feeding device, in particular, is a so-called measuring feeding device apt to measure the length of the yarn inserted during a pick. For this purpose four radially oriented, pin-shaped stop elements provided in the storage body are coupled to a planetary gear. The planetary gear is driven from the drive shaft of the winding element and displaces each stop element from a position close to the winding element and radially distant from the storage surface, to a position in front of a just forming winding of the yarn exiting from the winding element, and then in the axial direction into the stop position in which the withdrawn yarn is caught at the stop element. Subsequently, the stop element again is displaced in the radial direction and away from the windings. The stop element functions as a conveying element for the windings on the storage body and terminates the respective pick. Since the stop element is not able to start the pick, a controlled yarn clamp is provided downstream which clamps the yarn while the stop element is displaced away from the windings. The opening movement of the yarn clamp into the passive position then starts the pick. As each stop element moves only relatively slowly with the power drive and as the power drive needs a lot. of space, the storage body has to have an undesirably large diameter (strong ballooning effect). To achieve a high pick frequency, at least one further, similar feeding device is needed which operates in alternation. The mechanical load for the yarn is high. The mechanical load and the strong ballooning effect caused by the large diameter of the storage body tend to cause frequent yarn breakages or pick faults and lead to insertion delays in case of high yarn withdrawal speed.

A similar feeding device is known from EP0 250 359 A. Each stop element is one tooth of a gear wheel. Each tooth gradually is pushed between the windings on the storage surface as a consequence of the driving motion of the gear wheel derived from the driving shaft of the winding element, and is then conveyed forwards together with the windings before the tooth terminates the pick in the stop position. The yarn clamp needed for starting the pick is provided at the storage body. Due to the slow movement of each stop element in the feeding device and because of the large mounting space of the drive in the feeding device, a storage body having a relatively large diameter is needed for elevated pick speeds. The large diameter leads to an undesirably strong ballooning effect (high mechanical load in the yarn and considerable pick flight time delays).

It is an object of the invention to provide a feeding device as mentioned in the introduction which can be used for high pick frequencies and high pick speeds, even in case of delicate yarn material, which operates substantially without disturbances and which achieves optimally short insertion times.

Said object is achieved by providing a small diameter storage body, and a stop element which in its engagement position is moved axially into the stop position exclusively by the windings and the conveying motion of the windings.

The combination of a small diameter storage body and a stop element which axially is moved into the stop position exclusively by the advancing motion of the windings allows utilization of the yarn feeding device substantially without disturbances, even in the case of high pick frequencies and/or high pick speeds and even with delicate yarn material. The small diameter storage body significantly reduces the ballooning effect or the kinetic energy intermediately stored in a yarn balloon, respectively, such that very high insertion speeds, and in particular short insertion times, can be achieved without excessive mechanical load for the yarn. The small diameter storage body, however, needs a large number of windings for each pick. Mechanical disturbances of the movements of the windings on the storage body by the stop element should be avoided. This prerequisite is fulfilled when the stop element is moved exclusively axially into the stop position by the windings. The stop element does not need a drive for this movement. The stop element is taken along with the windings and follows the advancing movements of the windings with minimum or even no mechanical resistance, which advancing movement of the windings is generated in a suitable way by the winding process, i.e. the stop element is dragged by the windings. Since the axial movement of the stop element into the stop position does not need any control from outside or from inside, the drive of the stop element only has to control the precise engagement of the stop element between the windings and to release disengagement again later substantially in the radial direction. In the combination, these features result in a synergy effect leading to high operational reliability even in the case of high yarn speed and/or short pick times and/or high pick frequencies. A small diameter storage body means a storage body which has a significantly smaller outer diameter in contradiction to the conventional tendency of feeding devices having a yarn length measuring function. In feeding devices having a yarn length measuring function, a large storage body is provided to have as few windings as possible on the storage body for each pick and also to have only an axial short yarn supply on the storage body.

A conventional controlled yarn clamp may, under certain conditions, not be good enough to cope with high pick speeds and to precisely start the pick in adaptation to the weaving machine cycle. For this reason, the yarn clamp is equipped with a quick opening mechanism to assist in the positive effects of the small diameter storage body and of the stop element which is moved only by the windings into the stop position. The yarn clamp in this case is able to start the pick at a precisely predetermined point in time and particularly rapidly, e.g. within only a few milliseconds or even in a shorter period of time.

Expediently, the small outer diameter of the storage body defines a curvature of the circumference of the storage surface which at least substantially corresponds with the natural capability of natural, synthetic or compound yarn material to store a smallest unforced curvature. The yarn windings will lie relatively powerless, relaxed and in good order on the storage body. The rapid withdrawal of the yarn from this very small outer diameter storage body then only leads to a minimum ballooning effect. The result of the natural capability of the yarn to store a smallest unforced curvature means a certain bent yarn found when a free yarn section first is bent on a smooth surface to a very small loop and is then released. This loop expands somewhat but maintains then a residual curvature. This residual curvature is used as a guideline for dimensioning the outer diameter of the storage body. Astonishingly, it has been found that different yarn qualities and different yarn materials with very few exceptions develop very similar unforced residual curvatures and for that reason can be processed well on the small diameter storage body.

In case of an outer diameter between about 25 mm to 55 mm, preferably, and even in case of an outer diameter about only 35 mm to 40 mm, the ballooning effect even in the case of high pick speed is desirably weak. (The centrifugal force in the yarn is about proportional to the square of the radius of the curvature.) The small diameter allows astonishingly short insertion times even with moderate energy input, because the yarn is very willing to be withdrawn easily. The small diameter storage body may even be expedient for feeding devices for projectile or rapier weaving machines, e.g. in co-action with a withdrawal brake co-operating with the small diameter storage body. In such a case the stop element and the yarn clamp may be omitted.

The outer diameter may be so small that the axial length of the storage surface is substantially larger than the outer diameter.

Expediently, the stop element is connected by a hinge with a radial adjustment drive provided axially stationarily. The radial adjustment drive adjusts the stop element in a precisely timed manner and reliably into engagement in front of the just arriving yarn winding exiting from the winding element. The hinge or the bending section offers the necessary degree of freedom for the stop element thanks to which the stop element will be brought into the stop position only by the advance movement of the windings on the storage body substantially without any counter force.

In order to axially return the stop element in front of the first formed winding to prepare for the next yarn length measuring function, an axial adjustment drive is employed which returns the stop element which moves about the hinge or the bending section and after the stop element first has been brought radially into the release position. Alternatively, even several sequentially operating stop elements may be employed instead.

In the stop position the stop element is caught at an axial stop. This stop may be provided in the storage body or even radially outside of the storage body.

Catching the yarn in the stop position of the stop element causes the undesirable stretching effect or whiplash effect due to the momentary deceleration of the mass of the yarn. As a counter measure it is particularly expedient to associate an impact damper to the stop element in the stop position for alleviating/moderating the stretching effect or the whiplash effect. That measure reduces the danger of a yarn breakage considerably. The impact damper dissipates energy by resiliently giving way. The energy meant is introduced by the decelerated yarn into the stop element. The stop for the stop element may move e.g. counter to a spring force over a small travelling stroke either in the axial direction, in an inclined direction or in a circumferential direction of the storage body, respectively, in order to dissipate the energy. The stop element even may be elastically deformable in itself in order to carry out the impact damping effect as soon as the yarn is stopped abruptly when the stop element has reached the stop.

In order to precisely control and predetermine the point in time of the start of the pick by the yarn clamp, it is expedient to open the yarn clamp by an actuating solenoid and to provide for the armature of the actuating solenoid a certain idle stroke in relation to the clamping element of the yarn clamp. As soon as the actuating solenoid is excited, the armature uses the idle stroke to first accelerate free from the mass of the clamping element and the oppositely directed spring force, and first to build up a lot of kinetic energy during the acceleration, and then to displace the clamping element abruptly into the passive position after the idle stroke has been passed with high acceleration and/or high kinetic energy. In this way a yarn clamp opening time may be reached which is in the range of only a few milliseconds or even shorter.

In view of a precise yarn control in the operational phase in which the stop element is brought from the stop position into the release position, it may be expedient to move the yarn clamp which clamps the yarn substantially opposite to the withdrawal direction of the yarn towards the storage body. For this purpose a displacement drive is used, e.g. a stepper motor, which shifts or pivots the yarn clamp. By moving the yarn clamp while holding the yarn closer to the storage body the yarn section between the yarn clamp and the stop element placed in the stop position will be relaxed such that no significant stretching tension will be present in this yarn section when the stop element finally is displaced substantially radially out of the stop position. Such a yarn stretching tension, otherwise, would result in an abrupt relaxation during the movement of the stop element causing a disorder in the yarn windings on the storage body. First, after the stop element has been brought into the release position and/or after the yarn clamp has been brought into the passive position, the yarn clamp again is returned in the opposite direction.

Although the ballooning effect can be ignored in case of such a small storage body, the yarn may carry out a rotating movement in the final phase of the pick and within a movement space in which it might get caught by the yarn clamp or in the clamping section of the yarn clamp. For this reason the yarn clamp should be removable out of this moving area.

BRIEF DESCRIPTION OF THE DRAWINGS

An embodiment of the object of the invention will be explained with the help of the drawings, in which:

FIG. 2 is a schematic side view of a yarn processing system employing the yarn feeding device of FIG. 1, FIG. 3 is a schematic longitudinal section of a detail view of the yarn clamp.

DETAILED DESCRIPTION

Figure 1:
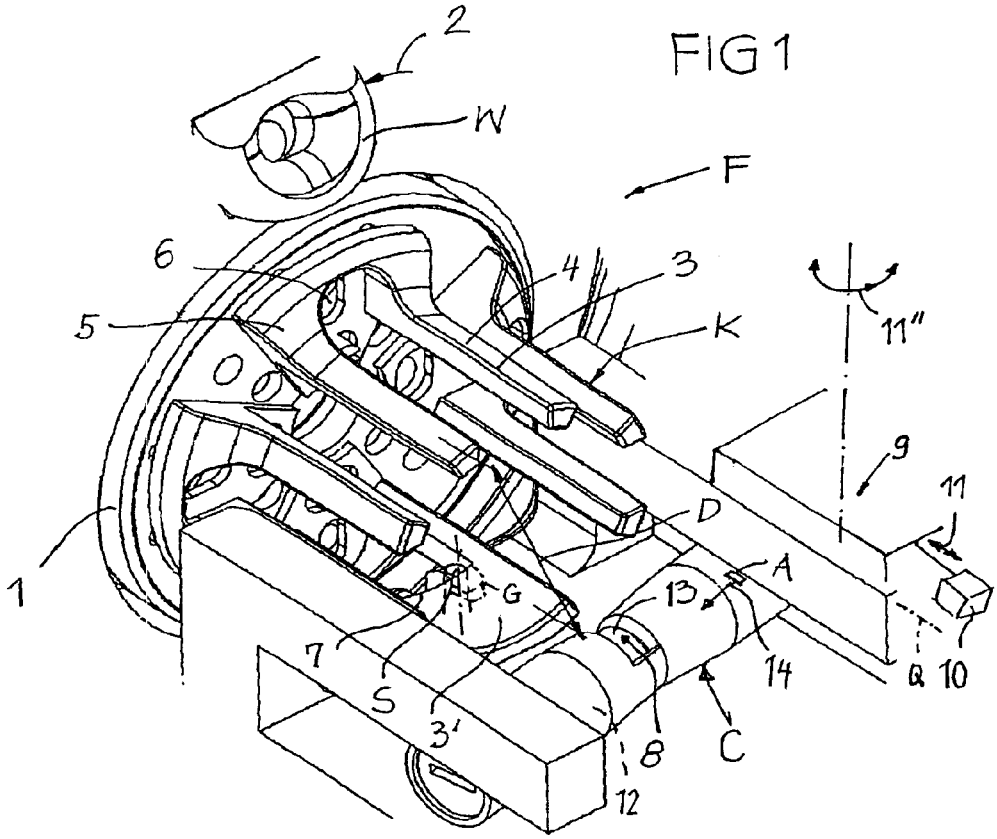
FIG. 1 is a perspective view of the main components of a feeding device according to the invention.

A feeding device F (FIGS. 1 and 2) having a yarn length measuring function, for a weaving machine T, comprises a stationary carrier 1. A storage body K is provided at the carrier 1. The storage body K may e.g. be similar to a rod cage having axially extending rods 3, the outer surfaces of which define a substantially cylindrical storage surface 4 tapering in FIG. 1 towards the right end. The rods 3 are secured by foot parts 5 to the carrier 1 such that they may be adjusted radially within a certain range (radial adjustment devices 6), in order to allow variation of the outer diameter D of the storage body and to adapt the winding length to the weaving width of the weaving machine. The outer diameter D of the storage body K defines a circumferential curvature of the storage surface 4 which circumferential curvature substantially corresponds to the natural capability of natural, synthetic or compound yarn material to store a smallest unforced curvature. The outer diameter D e.g. amounts only to between about 25 mm and 55 mm. Preferably, the outer diameter D is only about 35 mm to 40 mm. The axial length of the storage surface 4 (L in FIG. 2) may be longer than the measure of the outer diameter D.

A winding element W rotates around the outer circumference of the carrier 1 (arrow 2), e.g. a winding tube which is connected to a hollow drive shaft (not shown).

At the lower side of the carrier 1, two of the rods 3 are combined to a rod 3' forming axial stop 7 for a stop element S. A resiliently yielding impact damper G (indicated in dotted lines) may be associated to the stop 7. The stop element S could even be provided at another position and not at the lower side.

A clamping section 8 of a yarn clamp C is provided in front of the free front end of the storage body K, substantially axially aligned to the position of the stop element S. The yarn clamp C includes, preferably, a quick opening mechanism 9 for moving a clamping element 13 counter to the force of a spring 12 into a passive position (to open the yarn clamp) in which a yarn Y first held in the clamping section 8 is released. For example, an armature A of an actuating solenoid M is driven in the direction of an arrow 14, to displace the clamping element 13 from the clamping position shown in FIG. 1 into the passive position.

In addition, the yarn clamp C itself may be moved back and forth substantially parallel to the axis of the storage body or along an arc (double arrow 11, 11"), e.g. by pivoting the yarn clamp.

The schematic sectional view of FIG. 2 shows how the yarn exiting from the winding element W is wound in subsequent yarn windings YT on the storage surface 4 of the storage body K, in order to form an intermediate yarn supply. The yarn 1 is then withdrawn intermittently by an insertion device E of the weaving machine T out of this yarn supply. The weaving machine T e.g. is an air jet weaving machine.

In the shown embodiment, the yarn windings on the storage body K in FIG. 1 are conveyed forwards by a permanent winding process of the winding element 2. They are conveyed forwards in the direction to the front end of the storage body K (conveying motion B). Alternatively, in FIG. 2, in dotted lines, an advance assembly V is shown which e.g. is driven by the drive shaft of the winding element W and which separates the yarn windings YT from each other and/or conveys them in the direction towards the front end of the storage surface.

Figure 2A:
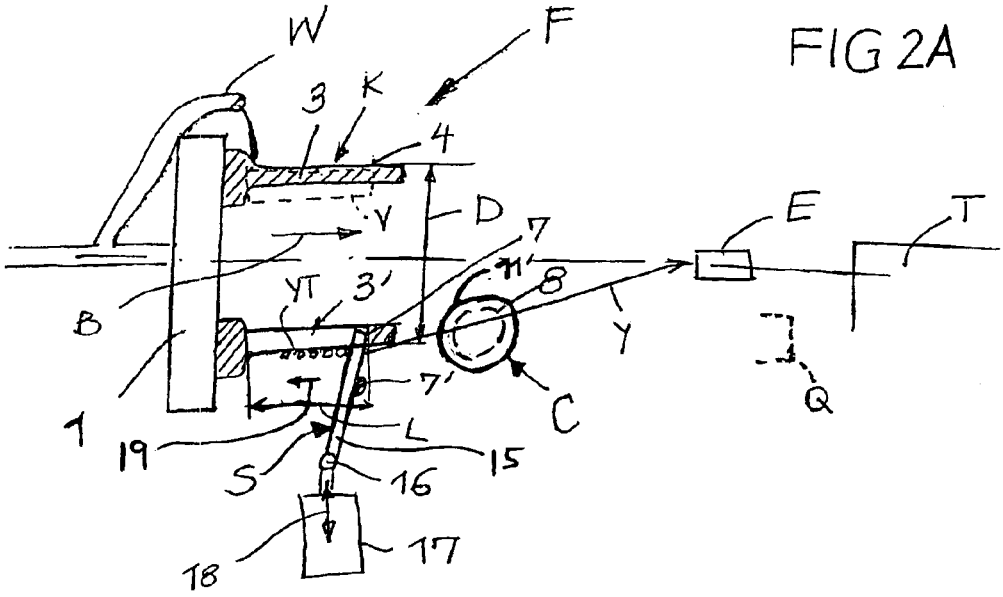
FIG. 2A is a view similar to FIG. 2, but shows the stop element in the stop position.
Figure 2B:
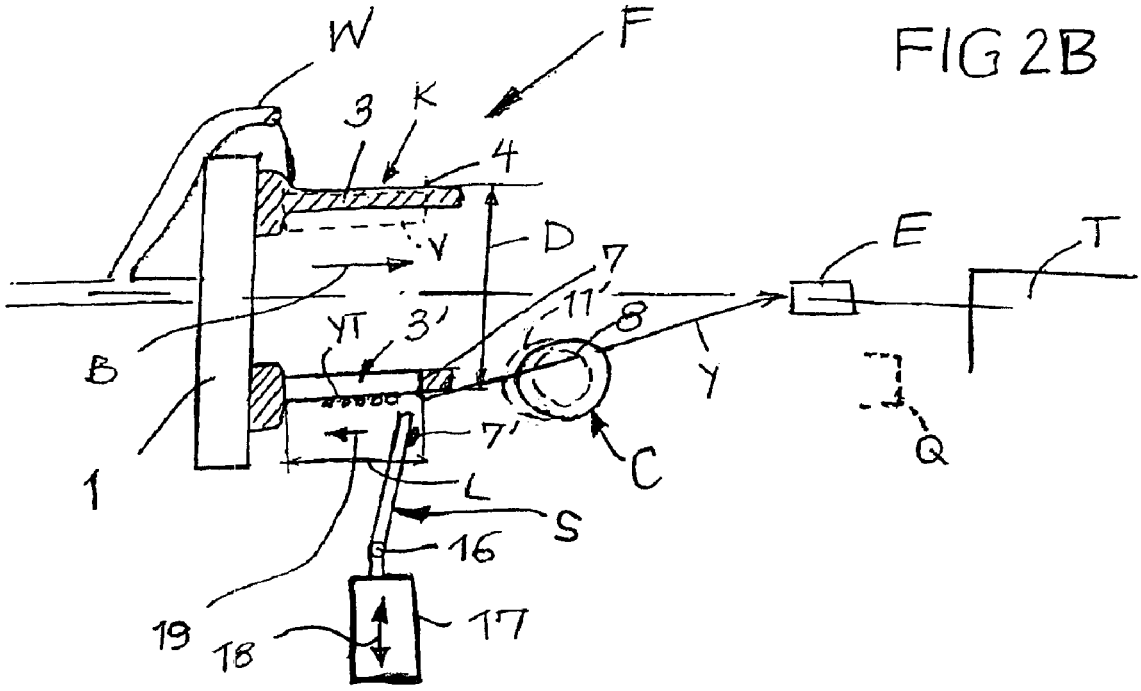
FIG. 2B is a view similar to FIG. 2, but shows the stop element in the release position.
Figure 2C:
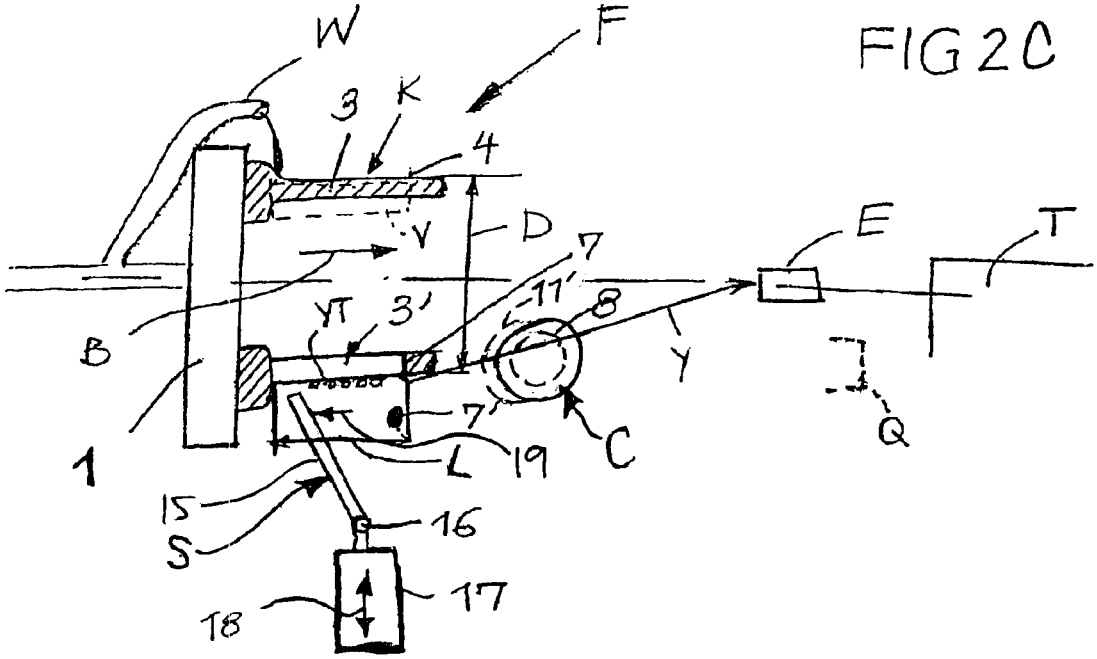
FIG. 2C is a view similar to FIG. 2, but shows the stop element in the initial position wherein the stop element may be brought into engagement again in front of a first developing winding.

The stop element S is a pin 15 which is connected via a hinge or a bending section 16 with an axially stationary radial adjusting drive 17 which, e.g. , is a solenoid drive. The radial adjusting drive 17 is designed to move the hinge 16 in the direction of the double arrow 18 back and forth, particularly in order to push the stop element S into engagement between the windings YT (as shown) or to pull the stop element S into a release position (as shown in FIG. 2B) in which the stop element S does not have any influence on the windings YT. The stop element S in FIG. 2 is shown just engaging into the path of the first produced winding YT. During the further rotational movement of the winding element W new windings are formed. The conveying motion B of the yarn windings YT moves the stop element S into the stop position at the stop 7 (as shown in FIG. 2A). The pin 15 has a degree of freedom in the hinge or the bending section 16 thanks to which it may follow the conveying motion B substantially without counter force. At the end of a pick (FIG. 2A), the yarn Y abruptly is blocked against further withdrawal in the stop position of the stop element S. During the pick, the yarn clamp C remains in the passive position. The stop 7 may even be positioned outside of the storage body K, as indicated at 7', e.g.

After the end of the pick, the yarn clamp C is brought into the clamping position such that the yarn clamp C holds the yarn. Then the stop element S is displaced out of the engagement with the windings into the release position by the radial adjusting drive 17, as shown in FIG. 2B.

An axial drive 19, e.g. a solenoid, displaces the stop element S in the release position again into the initial position in which the stop element S (FIG. 2C) may be brought in engagement again in front of the first developing winding. As soon as a pick has to start depending on the cycle of the weaving machine, the yarn clamp C is adjusted into the passive position. Thanks to the further rotational motion of the winding element W, the stop element S again is brought by the windings YT into the stop position (FIG. 2A) in which it later terminates the pick.

The yarn section between the yarn clamp C and the stop element S is held stretched out, when after the termination of the pick and after adjusting the yarn clamp C into its clamping position the stop element S has reached the stop position (the insertion device E normally builds up a basic tension force in the yarn). The stretching of this yarn section may result in an abrupt relaxation of this yarn section when the stop element is pulled back into the release position. The abrupt relaxation could cause a disorder of the windings on the storage body (formation of snarls or tangles). As a counter measure here, the yarn clamp C is moved by the drive 10, into the position 11' in FIG. 2A (shown in dotted lines in FIGS. 2, 2B and 2C), to allow the stretched yarn section to relax, and while the stop element S is in the stop position and the yarn clamp C is adjusted into the clamping position, respectively. As soon as then the stop element S is brought into the release position (FIG. 2B), or even after also the yarn clamp C has been adjusted into the passive position, the yarn clamp C again is returned into the initial position by the drive 10 (FIG. 2B).

The yarn clamp C, e.g. may be moved completely out from the motion area of the yarn Y (pivoted position Q in FIG. 1). For this function, a separate actuator (not shown) may be provided, or even the drive 10 may be used. Alternatively, a shielding could be moved over the clamping section 8. Or, at least, a deflector could be provided at the yarn clamp C to avoid the danger that the yarn might become caught.

The yarn clamp C in FIG. 3 has, analogous to FIG. 1, a tube-shaped housing 20. A spring 12 presses the clamping element 13 in the clamping section 8 against a clamping surface 21 (clamping position). The quick opening mechanism 9 contains the solenoid M which displaces an armature A in the direction of an arrow 14 upon excitement in order to actuate the clamping element 13 counter to the spring 12 to adjust the clamping element 13 from the shown clamping position into the passive position and to release the yarn. An idle travel stroke 23 is provided in the clamping position and with the solenoid M not excited between the armature A and the clamping element 13. Upon excitement of the solenoid M the armature A uses the idle stroke 23 to accelerate as strongly as possible and to build up kinetic energy, and to move the clamping element 13 with high force and as rapidly as possible first after having passed the idle stroke 23. In this fashion the opening time of the yarn clamp C may be reduced only a few milliseconds or even less.

The armature A maintains the clamping element 13 in the passive position as long as the solenoid M is excited and until the stop element reaches the stop position and terminates the pick. Then the solenoid is de-energised. The clamping element 13 now returns into the clamping position under the force of the spring 12. The armature A is returned into its initial position by a separate, e.g. very weak, return spring 22. In the initial position of the armature A again the idle stroke 23 is adjusted with the predetermined magnitude.

What is claimed is:

1. A feeding device having a yarn-length measuring function for a weaving machine, said device comprising:

a stationary storage body of a small outer diameter and defining an axis and a storage surface for intermediately storing a yarn supply defined by a plurality of yarn windings conveyed on said storage body in a conveying direction corresponding to a yarn-withdrawal direction, the yarn being intermittently withdrawn from the yarn supply in picks;

a rotatable winding element for depositing yarn on said storage body; and a substantially pin-shaped stop element and a control assembly disposed outside said storage body for moving said stop element, said control assembly moving said stop element into an engaged position wherein said stop element engages the yarn on said storage body and a release position wherein said stop element is disengaged from the yarn on said storage body, said stop element in said engaged position being axially movable into a stop position solely by the yarn windings as the yarn windings are conveyed in the conveying direction, said stop element in said stop position blocking withdrawal of the yarn from said storage body in the yarn-withdrawal direction so as to terminate a respective pick.

2. The feeding device of claim 1–3, wherein said control assembly is stationary in the axial direction and includes a drive which moves said stop element radially between said engaged and release positions.

3. The feeding device of claim 2, wherein said stop element is hingedly connected to said drive to permit movement of said stop element in the axial direction solely by the conveying motion of the yarn windings being wound onto said storage surface behind said stop element, said drive being a first drive and said control assembly including a second drive which moves said stop element, when in said release position, substantially axially in a direction opposite to the conveying direction of the yarn windings from said stop position and into an initial position axially spaced from said stop position wherein said stop element is positioned axially in front of a first-developing winding on said storage body.

4. The feeding device of claim 3, wherein said stop element is hingedly connected at a radially outer end thereof to said first drive, and a radially inner end of said stop element is moved in the axial direction solely by the conveying motion of the yarn windings on said storage body.

5. The feeding device of claim 4, further including an energy-dissipating impact damper disposed within said storage body which cooperates with said stop element when said stop element reaches said stop position.

6. The feeding device of claim 1, further including an axial stop disposed to abut said stop element in said stop position, said stop being disposed inside or radially outside of said storage body.

7. The feeding device of claim 1, further including a yarn clamp disposed downstream of said stop element for initiating a respective pick, said yarn clamp being adjustable between a clamping position wherein the yarn is held by said yarn clamp and a passive position, said yarn clamp being disposed in said passive position during a pick and in said clamping position at the end of a pick.

8. The feeding device of claim 7, wherein said yarn clamp includes a clamp element movable between said clamping and passive positions, said clamp element being normally biased into said clamping position, said yarn clamp further including an opening mechanism which quickly moves said clamp element from said clamping position and into said passive position.

9. The feeding device of claim 8, further including a drive for temporarily moving said yarn clamp out of a range of movement of the yarn.

10. The feeding device of claim 8, further including a drive which selectively moves said yarn clamp towards and away from said storage body in a direction substantially parallel to the yarn-withdrawal direction, said drive moving said yarn clamp towards said storage body when said stop element is in said stop position and said yarn clamp is in said clamping position, said drive moving said yarn clamp away from said storage body when said yarn clamp is in said passive position, and said drive comprises one of a linear displacement drive and a pivoting drive.

11. The feeding device of claim 7, wherein said yarn clamp includes a clamp element, said clamp element being normally biased in a first direction into engagement with a clamping surface in said clamping position, and an opening mechanism including a solenoid and an armature, said solenoid when energized actuating said armature such that said armature moves said clamp element in a second direction opposite to said first direction to place said clamp element in said passive position, said armature having an actuating end face which cooperates with an adjacent end face of said clamp element to move said clamp element into said passive position, and an idle stroke is defined between said end faces when said solenoid is de-energized to allow acceleration of said armature when said solenoid is energized.

12. The feeding device of claim 1, wherein said storage body includes an outer diameter of between about 25 mm and about 55 mm.

13. The feeding device of claim 12, wherein said outer diameter of said storage body is between about 35 mm and about 40 mm.

14. The feeding device of claim 1, wherein said storage surface has an axial length which is greater than an outer diameter of said storage body.

15. A feeding device having a yarn-length measuring function for a weaving machine, said device comprising:

a winding element driven for rotation;

a storage body defining an axis and a storage surface for intermediately storing a yarn supply defined by a plurality of yarn windings conveyed in a conveying motion on said storage body corresponding to a yarn-withdrawal direction, the yarn being intermittently withdrawn from the yarn supply in picks, said storage body having a small outer diameter between about 25 mm and about 55 mm; p1 at least one pin-shaped stop element which is axially and radially movable by a control assembly disposed outside said storage body, said control assembly moving said stop element relative to said storage body into an engaged position wherein said stop element engages the yarn on said storage body and a release position wherein said stop element is disengaged from the yarn on said storage body, said stop element in said engaged position being movable substantially axially into a stop position exclusively by the yarn windings and the conveying motion thereof to terminate a respective pick; and p1 a controlled yarn clamp disposed downstream of said stop element for starting a respective pick.

16. The feeding device of claim 15, wherein said outer diameter of said feeding device is between about 35 mm and about 40 mm.

17. The feeding device of claim 15, wherein said stop element in said stop position blocks withdrawal of the yarn from said storage body in the yarn-withdrawal direction.

18. The feeding device of claim 15, wherein said control assembly includes a first drive which moves said stop element radially between said engaged and release positions, said stop element being hingedly connected to said first drive to permit axial movement of said stop element in the axial direction solely by the conveying motion of the yarn windings being wound onto said storage surface behind said stop element, and a second drive which moves said stop element, when in said release position, axially in a direction opposite to the conveying motion of the yarn windings from said stop position and into an initial position axially spaced from said stop position wherein said stop element is positioned axially in front of a first-developing winding on said storage body.

19. The feeding device of claim 15, wherein said yarn clamp includes a clamp element movable between a yarn clamping position and a passive position, said clamp element being disposed in said passive position during a pick and in said clamping position at the end of a pick and being normally biased into said clamping position, said yarn clamp further including an opening mechanism which quickly moves said clamp element from said clamping position and into said passive position.

20. The feeding device of claim 19, further including a drive which selectively moves said yarn clamp towards and away from said storage body in a direction substantially parallel to the yarn-withdrawal direction, said drive moving said yarn clamp towards said storage body when said stop element is in said stop position and said yarn clamp is in said clamping position, said drive moving said yarn clamp away from said storage body when said yarn clamp is in said passive position, and said drive comprises one of a linear displacement drive and a pivoting drive.

21. The feeding device of claim 15, wherein said storage surface has an axial length greater than an outer diameter of said storage body.

22. A feeding device having a yarn-length measuring function for a weaving machine, said device comprising: p1 a winding element driven for rotation;

a storage body defining an axis and a storage surface for intermediately storing a yarn supply defined by a plurality of yarn windings conveyed in a conveying motion on said storage body corresponding to a yarn-withdrawal direction, the yarn being intermittently withdrawn from the yarn supply in picks, said storage surface defining an outer diameter of said storage body and having a circumferential curvature corresponding substantially to a capability of natural, synthetic or compound yarn material to store a smallest unforced curvature;

at least one pin-shaped stop element which is axially and radially movable by a control assembly disposed outside said storage body, said control assembly moving said stop element relative to said storage body into an engaged position wherein said stop element engages the yarn on said storage body and a release position wherein said stop element is disengaged from the yarn on said storage body, said stop element in said engaged position being movable substantially axially into a stop position exclusively by the yarn windings and the conveying motion thereof to terminate a respective pick; and a controlled yarn clamp disposed downstream of said stop element for starting a respective pick.

* * * * *